US005479907A

United States Patent [19]

Walker, Jr.

[11] Patent Number: 5,479,907

[45] Date of Patent: Jan. 2, 1996

[54] COMBINATION IN-LINE AIR-FILTER/AIR-OIL SEPARATOR/AIR-SILENCER WITH PRESEPARATOR

[76] Inventor: Robert A. Walker, Jr., 8326 Jamieson St., Northridge, Calif. 91325

[21] Appl. No.: 273,880

[22] Filed: Jul. 12, 1994

[51] Int. Cl.[6] ..... F02B 77/00

[52] U.S. Cl. ..... 123/573; 123/198 E; 123/41.86; 55/DIG. 19; 55/DIG. 21

[58] Field of Search ..... 123/572, 573, 123/574, 41.86, 198 E; 55/276, 462, 441, DIG. 19, DIG. 21, 461; 181/214, 231, 324, 229

[56] References Cited

U.S. PATENT DOCUMENTS

| | | | |
|---|---|---|---|
| 2,642,052 | 6/1953 | Wagner et al. | 123/573 |
| 3,087,474 | 4/1963 | Catha | 123/41.86 |
| 3,721,069 | 3/1973 | Walker | 55/319 |
| 4,162,904 | 7/1979 | Clay et al. | 181/231 |
| 4,184,858 | 1/1980 | Walke | 55/228 |
| 4,401,093 | 8/1983 | Gates et al. | 123/572 |
| 4,724,807 | 2/1988 | Walker | 123/196 A |
| 4,957,517 | 9/1990 | Linnert | 55/276 |
| 5,140,957 | 8/1992 | Walker | 123/198 E |
| 5,277,154 | 1/1994 | McDowell | 123/41.86 |
| 5,347,973 | 9/1994 | Walker | 123/574 |
| 5,417,727 | 5/1995 | Bowen et al. | 181/214 |

*Primary Examiner*—Marguerite Macy
*Attorney, Agent, or Firm*—Christie, Parker & Hale

[57] ABSTRACT

The combination apparatus, preseparator, vacuum regulator and check valve silences and filters air flow and separates air-contaminant mixtures. The combination apparatus comprises an annular housing having an outer wall and a channel defining a central axis. The channel has a primary gas inlet coupled to an air filter, a primary gas outlet coupled to an engine induction system, and a channel wall therebetween. A secondary inlet port passes through the outer wall and a secondary inlet port defines an opening in the channel. A baffle is axially disposed within the housing defining a first and second flow passageway. Second baffles are disposed within the first and second passageways to effect serpentine flow through each flow passageway and filter material is disposed within each flow passageway. A preseparator is coupled between the secondary inlet and an engine breather and has an annular housing with preseperator baffles disposed therein for effecting serpentine flow therethrough. Filter material is disposed within the preseparator. A vacuum regulator is coupled between the preseparator and engine breather and a check valve is coupled between a drain coupling in the combination apparatus and an engine block, to prevent oil carry over into the combination apparatus.

60 Claims, 8 Drawing Sheets

COMBINATION IN-LINE AIR-FILTER/AIR-OIL SEPARATOR/AIR-SILENCER WITH PRESEPARATOR

FIELD OF THE INVENTION

The present invention relates generally to air-oil separators, more, specifically to a closed system which silences and filters air in a flow line input to an engine, separates oil out of the contaminated engine atmosphere and regulates the pressure of the engine atmosphere.

BACKGROUND OF THE INVENTION

Prior U.S. Pat. Nos. 3,721,069, 4,184,858, 4,724,807 and 5,140,957 relate to air-oil separators. The specifications and claims of these patents are incorporated herein by reference. In the '069 patent, a separator is discloclosed and claimed that uses a baffle for producing primary separation of oil from an air-oil mixture entering the separator and and causes the mixture to be driven through a filteration material. The oil separated from the mixture then drops to a reservoir for return back to the engine crankcase, oil pump, etc. An outlet conduit of the separator has a greater cross-sectional area relative to an inlet port to provide a means whereby the pressure of the air-oil mixture or vapor introduced into the device can be reduced to near atmospheric pressure, contributing significantly to the action of the device.

In the '858 patent, which is an adaption of the '069 patent, the filtering material within the separator apparatus is coated with a fluid to assist in the removal of the oil from the air-oil mixture. The filtered air output of the separator disclosed and claimed in either the '069 or the '858 patent may be passed to the clean air intake of the engine.

The '807 patent discloses an in-line air-oil separator apparatus comprising an annular housing having an outer wall and a channel wall defining a channel having a central axis, the channel having a primary gas inlet and a primary gas outlet and a channel wall. The apparatus has a secondary inlet port passing through the outer wall and a secondary outlet port defining an opening in the channel wall. The secondary inlet and outlet ports are arranged such that there is no straight line flow between the secondary inlet and the secondary outlet. Baffles are located between the inside surface of the outer wall and the inside surface of the channel wall to direct the entering air-oil mixture in a manner enhancing air-oil separation by the apparatus.

Increasingly stringent environmental regulations and a heightened consciousness of environmental conservation has mandated cleaner operation of hydrocarbon powered sources such as automobiles, boats, trucks, motorcycles, or the like. As a result, blow-by devices such as pollution control valves (PCV) have become required standard equipment for all automobiles. These blow-by devices capture emissions from the crankcase of a hydrocarbon burning engine and communicate them in a closed system to the air intake system for combustion. The emissions generated from the crankcase of diesel engines are heavily laden with oil and other heavy hydrocarbons. Accordingly, air-oil separators such as those previously described have been developed in an effort to make the operation of such engines cleaner and more efficient. Such devices function to silence and filter air in an air inlet flow line to an engine, separate oil and other hydrocarbons emitted from a contaminated engine atmosphere, and regulate the pressure within the engine.

The '957 patent is an improvement of the system described in U.S. Pat. No. 4,274,807 and comprises an air-oil separator system comprising a combined air-filter/air-oil separator/air-silencer and a vacuum limiter. In addition to the air-oil separator disclosed in the '807 patent, the '957 patent discloses and claims an air-silencer that resides within the channel wall of the air-separator apparatus that serves to quiet the noise level of the air entering the apparatus via the secondary inlet port. The improved system comprises an in-line vacuum limiter to limit the amount of vacuum imposed on the crankcase of the engine by the air-oil separator to a predetermined amount. The system also comprises a check valve attached in-line to the fluid line extending from a drain coupling of the air-oil separator to the engine's oil reservoir. The check valve prevents oil from being sucked up out of the oil reservoir and into the air-oil separator during operation.

Increasing governmental regulation and environmental awareness has required that the emissions from hydrocarbon burning engines be closely regulated. Accordingly, it is desirable that the emissions from the crankcases of hydrocarbon burning engines be treated in a most efficient manner. A need, therefore, exists to provide an improved apparatus for separating contaminants from the crankcase emissions of hydrocarbon powered engines in an efficient manner, minimizing the extent of contaminants released into the environment and improving the operation of the engine.

SUMMARY OF THE INVENTION

There is, therefore, provided in the practice of this invention a closed system with very few moving parts for regulating/cleansing the environment of an internal combustion engine in an efficient manner, the system comprises a combination apparatus, preseparator apparatus, vacuum regulator, and check valve. The combination apparatus comprises an annular air filter joined to an annular housing having an outer wall and a channel in the housing defining a central axis. The channel has a primary gas inlet at one end coupled to the air filter, a primary gas outlet at an opposite end adapted to be coupled to an engine induction system, a channel wall therebetween. The annular housing has a secondary inlet port in the outer wall and a secondary outlet port defining an opening in the channel wall such that there is no straight line flow path between the secondary inlet and the secondary outlet.

The housing comprises a baffle disposed axially between the outer wall and the channel wall, defining a first flow passageway defined exteriorly by the baffle and interiorly by the channel wall, and a second flow passageway in serial flow with the first flow passageway and defined exteriorly by the outer wall and interiorly by the baffle. A plurality of second baffles are disposed within the first and second flow passageways and extend radially between the baffle and the channel wall and the baffle and the outer wall, respectively. The baffles are positioned within each flow passageway in a staggered arrangement to direct an air-oil contaminant mixture through each flow passageway in a serpentine flow pattern. A fiber material is disposed within the first and second flow passageways between the second baffles to reduce air velocity through the combination apparatus and provide enhanced oil vapor condensation sites.

The secondary inlet is coupled to an outlet opening of a preseparator apparatus. The preseparator apparatus comprises an annular housing having an outside wall defining a central axis, a plurality of preseparator baffles disposed within the housing, and an inlet opening at an end of the housing opposite to the outlet opening. The preseparator baffles are attached to the housing in a staggered arrangement to direct an air-oil contaminant mixture through preseparator apparatus in a serpentine flow pattern. A fiber material is disposed within the preseparator apparatus between the preseparator baffles to reduce air velocity and provide enhanced oil vapor condensation sites.

A vacuum regulator is coupled to the inlet opening of the preseparator apparatus at an outlet port and to an engine breather at an inlet port. The vacuum regulator comprises a vacuum relief valve that can be drawn into a closed position, closing an air flow passageway between the engine crankcase and an engine air-induction system, by an increase in vacuum beyond a predetermined level, thereby, eliminating the possibility of oil carry over from the engine crankcase into the combination apparatus.

A check valve is coupled by fluid flow lines between a drain coupling attached to the outer wall of the combination apparatus and an engine block to facilitate liquid contaminant removal and to prevent oil carryover due to the existence of higher vacuum in the combination apparatus than in the engine block. The check valve permits a one-way only liquid flow in a direction from the drain to the engine block when a predetermined pressure head is exerted on the check valve by liquid contaminant collected by the drain.

BRIEF DESCRIPTION OF THE DRAWINGS

The foregoing and other features of the invention will be better understood by reference to the drawings. Wherein.

DETAILED DESCRIPTION

The present invention is an improvement of the system described in U.S. Pat. No. 5,140,957. The present invention comprises a combined air-filter/air-oil separator/air-silencer, a preseparator, and a vacuum regulator.

Figure 1:
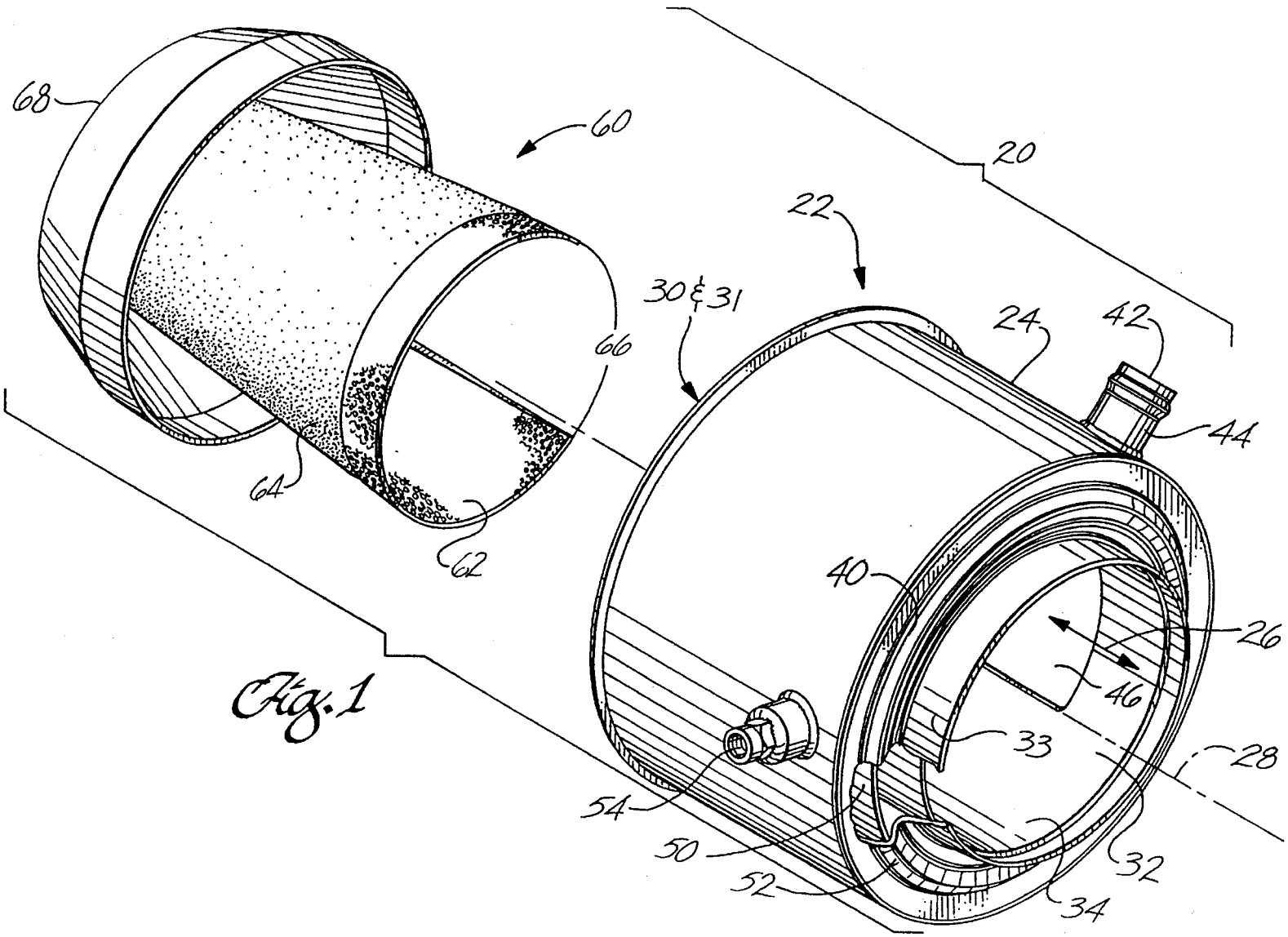
FIG. 1 is an exploded perspective and partial cutaway schematic view of a combination apparatus constructed in accordance with principles of this invention.

FIG. 1 shows a combination apparatus 20 for silencing and filtering intake air and separating contaminants (including oil and other heavy hydrocarbons) from pressurized air-contaminant mixtures. Only the silencer and separator aspects of the apparatus are shown. The apparatus is formed from an annular housing 22 having an outer wall 24. The outer wall may be formed from aluminum, sheet metal or other material suitable for withstanding the temperature and environment associated with internal combustion engines.

A channel 26 forms the central portion of the annular housing and defines an axis 28 about which the housing is substantially symmetrical. The channel has a primary gas inlet 30 at one end of the annular housing. The primary gas inlet is joined to an annular air-filter 102 (not shown in FIG. 1, see FIG. 5) which is also substantially symmetrical about axis 28. The channel also has, at the opposite end from the primary gas inlet 30, a primary gas outlet 32, typically coupled to an air induction system for an engine. The channel has a channel wall 34 preferably formed from the same material from which the outer wall 24 was formed. The channel wall extends along axis 28 a distance greater than the length of the outer wall 24 forming an inlet flange 31 (not shown) and an outlet flange 33 for coupling to respective hoses or ducts for conducting the primary air flow and for allowing continuous flow between the hoses or ducts and the channel 28. The inlet flange 31 is substantially the same as outlet flange 33, but faces in the opposite direction relative to the outlet flange. Air flows through the channel from the inlet flange 31 to the outlet flange 33.

The outlet wall and the channel are maintained in spaced apart relation with respect to each other through a pair of convoluted end surfaces 40. Only the convoluted end surface on the outlet flange end of the apparatus is shown in the drawings. However, it is to be understood that an identical convoluted end surface exists at the inlet flange end 30 of the housing. Both convoluted end surfaces are riveted or otherwise fastened to the channel walls at each flange in a manner such as that described in U.S. Pat. No. 4,724,807 to form a air-tight, except as described below, hollow enclosure 22.

A secondary inlet port 42 extends through the outer wall 24 by means of tube 44 which is preferably riveted or spot welded to the outer wall. The secondary inlet port provides a gas flow path for directing an air-oil mixture into the interior of the annular housing. The secondary inlet is adapted to be coupled to a breather connection of an internal combustion engine as described more fully below. The annular housing 22 further comprises a secondary outlet port 46 opening in the channel wall 34.

An air-silencer 60 is contained within the channel wall 34. Spaced away from the inside surface of the channel wall 34, and also oriented on the central axis 28, is an annular or conical tube 62 formed from perforated aluminum or other similar material. Sound deadening material 64 fills the space between the annular piece of perforated material 62 and the inner side of the channel wall 34. A section 66 of both the perforated material and sound deadening material is cut away so as not to cover the secondary outlet 46 in the channel wall to accommodate the passage of air from the secondary outlet, through the air-silencer and into the air intake of an engine.

An annular cap 68 is welded or similarly attached to the ring formed by the primary gas inlet end of the annular perforated material 62. The cap 68 has an opening (not shown) equal in diameter to the diameter of the inlet end of the perforated material 62 to accommodate the passage of air therethrough. When the air-silencer 60 is installed in the channel 26, cap 68 fits neatly over the primary gas inlet flange 31 of the channel, preventing interruption of the fluid air flow over the primary gas inlet flange into the channel.

The beneficial noise reduction realized from the addition of the air-silencer has been measured to be in the range of 8.5 dB at a channel air flow rate of 1400 cubic feet per minute (noise level reduced from 122.0 dB to 113.5 dB). The combination apparatus may be constructed with or without the air-silencer installed with no effect on the overall operation of the apparatus.

The secondary outlet 46 is formed in the housing in such a way that there is no straight line flow path between the secondary inlet and the secondary outlet. The interior of the housing defines a dual-pass serpentine flow passageway for fluid flow between the secondary inlet and the secondary outlet. The passageways are defined at an outermost extreme by the inside surface of the outer wall 24 and at an innermost extreme by the inside surface of the channel wall 34. As will be discussed more fully below, a first baffle 50 is positioned in the housing between the outer wall 24 and the channel wall 34 and spaced apart from each, defining a first and second flow passageway. Both edges of the first baffle extend into respective convolutions 52 in the convoluted end surfaces 40.

As shown in FIG. 1, the first baffle 50 contacts in the convoluted end a first convolution 52 formed as a ridge extending away from the interior of the housing. The edge of the baffle contacts the inside vertex formed by the ridge. In the preferred embodiment, the edges of the first baffle are sealed in the vertex with a silicone or epoxy sealer for preventing passage of the crankcase air between the baffle and the convoluted surface. The outer wall, the baffle and the channel wall are preferably concentric. Accordingly, the baffle 50 divides the interior of the housing into two concentric fluid flow passageways. The first being defined by the inside surface of the outer wall 24 and an adjacent surface of the baffle 50, and the second being defined by an opposite surface of the baffle 50 and the inside surface of the channel wall 34.

A drain coupling 54 is preferably centrally mounted between the edges of the outer wall 24 to allow oil to drain from the interior of the annular housing. A hose or other similar conduit may be attached to the coupling for feeding the oil to an engine block. A check valve is preferably coupled in a conventional manner between the hose and the engine block, to prevent back flow of oil from the crankcase to the interior of the annular housing. As will be discussed more fully below, the check valve is necessary because the vacuum level in the crankcase may be lower than the vacuum level in the housing, thereby inducing fluid flow from the crankcase into the housing. The circumferential location of the drain coupling with respect to the secondary inlet 42 is determined by the final orientation of the housing with respect to the engine. Once the final orientation is determined, the drain coupling is mounted to the outer wall at the bottom of the housing so that the oil stream enters the coupling through force of gravity. However, for any given engine design, the position of the coupling will be the same.

Figure 2:
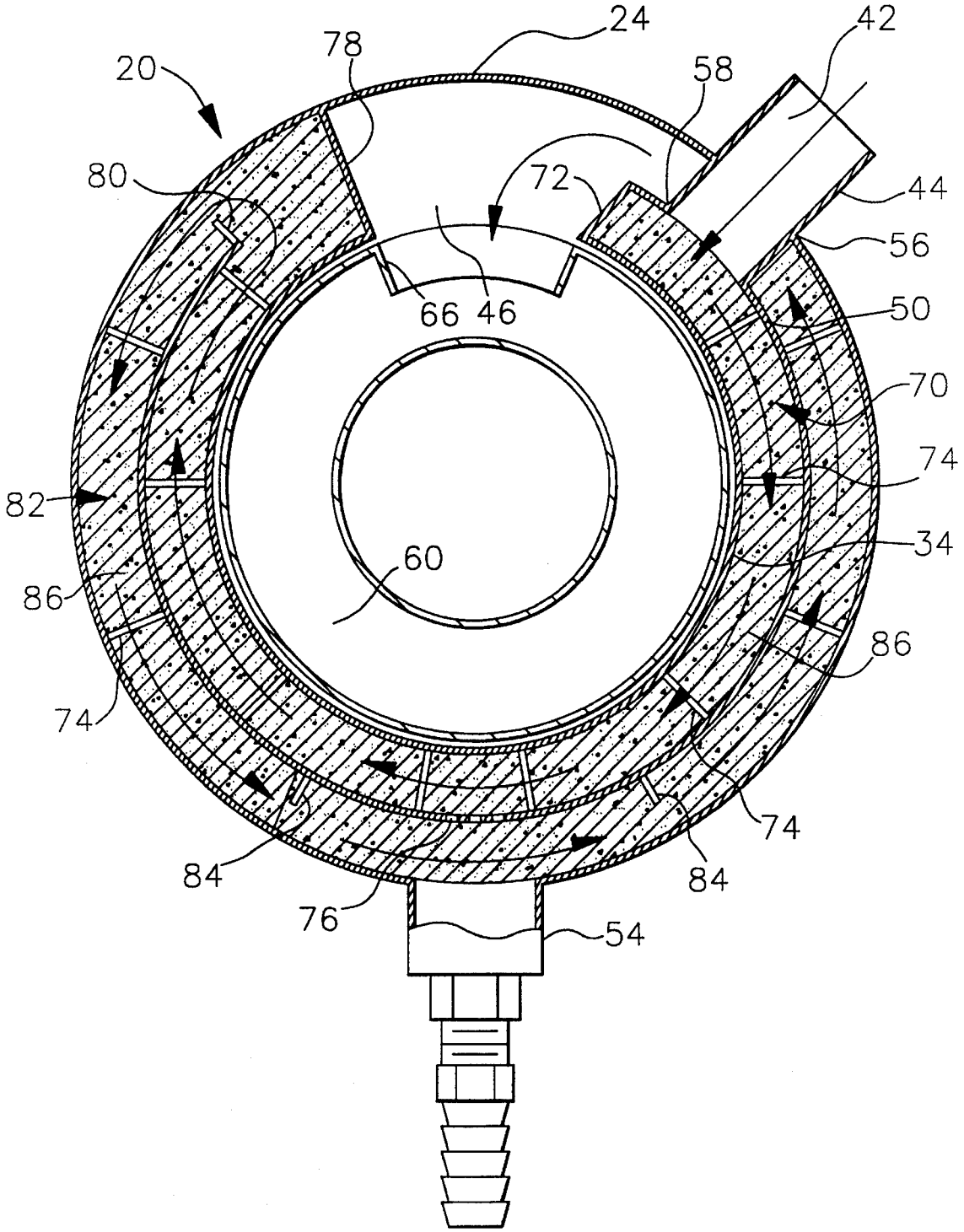
FIG. 2 is a semi-schematic cross-sectional front view of the combination apparatus of FIG. 1, as viewed from a primary gas inlet end of the apparatus.

FIG. 2 is a cross-sectional view of the combination apparatus of FIG. 1, including the air silencer 60 installed in the channel such that the secondary outlet 46 is placed into alignment with the cut-out section 66. For purposes of reference, the second inlet 42 is oriented near the physical top of the apparatus 20 and the drain 54 is located at the bottom of the apparatus. The single baffle 50 fits into a single convolution on the respective convoluted end surfaces 40. In the embodiment shown in FIG. 2, the tube 44 extends through a tube opening 56 in the outer wall 24 of the apparatus to a position within the interior of the housing where it is attached at an end to the baffle 50. The tube opening is sized to accommodate the passage of the tube therethrough. The tube is attached about an adjacent outside circumferential surface to the tube opening in a manner forming an airtight seal between the outer wall and the outside surface of the tube. The end of the tube extending into the interior of the housing is attached to a baffle opening 58 in a manner forming an air tight seal between the tube end and the baffle opening. Accordingly, a fluid flow mixture entering the secondary inlet port 42 passes through the tube 44 and is directed past the outer wall 24, through the baffle opening 58 and into a first fluid flow passageway 70 defined between the baffle 50 and the inside surface of the channel wall 34. The introduction of hot contaminated air directly to the first flow passageway has a beneficial cooling effect on the hot contaminated air due to the channel wall surface being cooled by the incoming air. This improves the oil separating effect.

The secondary outlet port 46 is positioned near the physical top of the apparatus. The fluid flow mixture entering the apparatus 20 via the secondary inlet port 42 is directed away from the secondary outlet port and through the first fluid flow passageway 70 by a baffle end 72 positioned adjacent the end of the tube, attached to baffle 50 and extending in a radial manner between the baffle 50 and the channel wall 34. The baffle end is attached to the baffle, channel wall, and end surfaces 40 in a manner forming an air tight seal.

Figure 3:
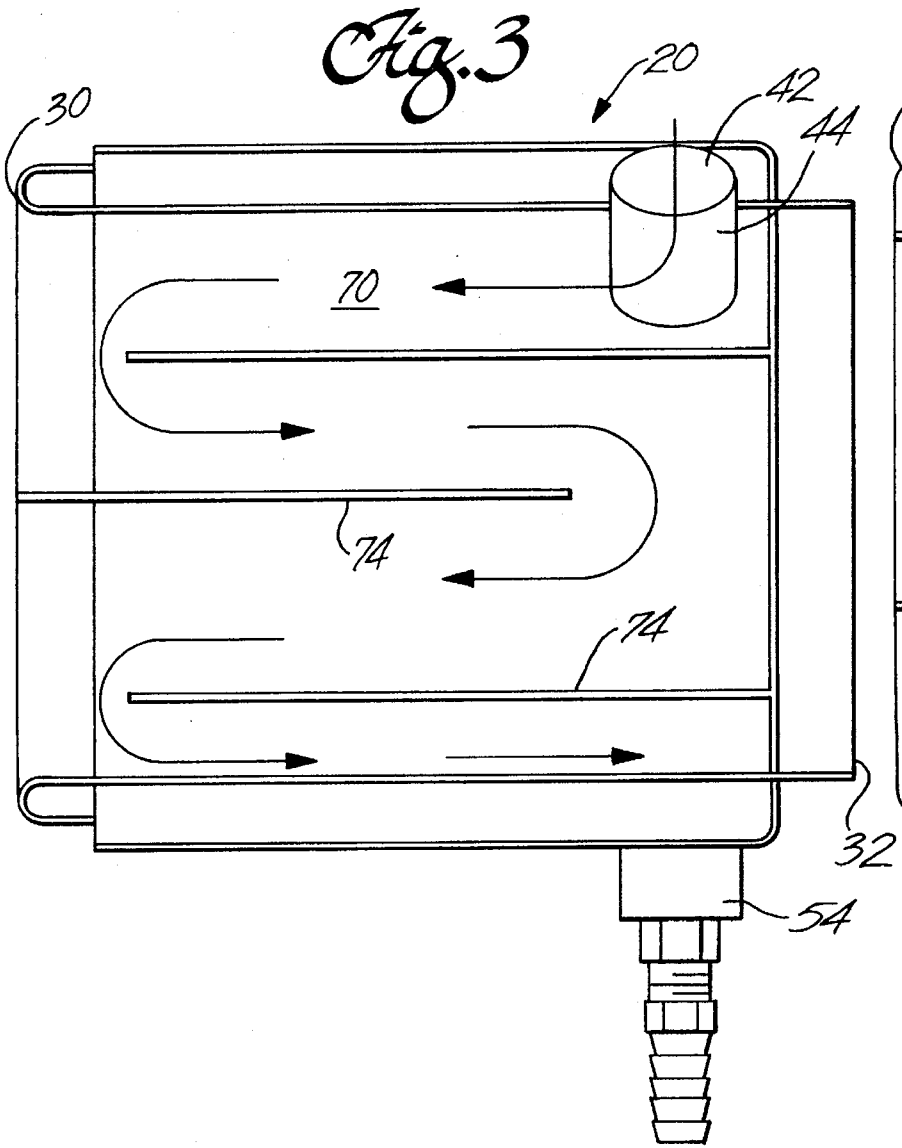
FIG. 3 is a semi-schematic cross sectional side view of the apparatus of FIG. 1, looking at a first flow passageway.

A plurality of second baffles 74 are positioned at predetermined locations within the first fluid flow passageway and extend radially from the inside surface of the channel wall 34 to the baffle 50. As better shown in FIG. 3, each second baffle is attached at its arcuate ends to the inside surface of the channel wall and to the baffle 50 in a manner forming an air tight seal about each respective surface. Each second baffle is attached at one of its axial ends to an end surface 40 at either the inlet or outlet end of the apparatus 20. To accomplish a serpentine flow of the fluid mixture through the first fluid flow passageway, each second baffle 74 is installed within the first fluid flow passageway with its axial end attached to a end surface 40 opposite to the end surface 40 to which each adjacent second baffle is attached. The serpentine flow of the flow mixture entering the apparatus 20 through the apparatus is illustrated by the arrows. Referring back to FIG. 2, a plurality of oil drainage holes 76 are formed in the baffle 50 and are oriented near the bottom of the apparatus to permit the drainage of oil separated from the entering air-oil mixture to the drain coupling 54.

As shown in FIG. 2, a channel wall end 78 extends radially from the channel wall 34 to the inside surface of the outer wall 24. The channel wall end is attached at its arcuate ends to the inside surface of the channel wall and inside surface of the outer wall in a manner forming an air tight seal. The axial ends of the channel wall end are attached to respective end surfaces 40 at the inlet and outlet end of the apparatus in a similar manner. The channel wall end is oriented near the physical top of the apparatus opposite to the baffle end 72 and forming the secondary outlet port 46 therebetween.

The air-oil flow mixture entering the secondary inlet port 42 travels through tube 44 into the first fluid flow passageway 58 and is directed in a serpentine fashion from a position near the top of the apparatus downwardly to the bottom of the apparatus, where oil separated from the flow mixture is allowed to drain to the drain coupling 54 via oil drainage hole 64, and upwardly to a position oriented near the top of the apparatus where the flow path of the mixture is redirected in an opposite direction. A baffle lip 80 is positioned along an end of the baffle 50 near the channel wall end 78. The baffle lip extends radially away from the baffle 50 a partial distance toward the inside surface of the outer wall 24.

A second fluid flow passageway 82 is defined between the inside surface of the outer wall 24 and the surface of the baffle 50. A plurality of second baffles 74 are positioned at predetermined locations within the second fluid flow passageway and extend radially from the first baffle 50 to the inside surface of the outer wall 24. The arcuate ends of each second baffle are attached to respective baffle 50 and outer wall surfaces in a manner forming an air tight seal. Like the second baffles disposed within the first fluid flow passageway 70, each second baffle within the second fluid flow passageway is attached at one axial end to an end surface at either the inlet side 30 or outlet side 32 of the apparatus 20 to direct the fluid mixture through the second fluid flow passageway in a serpentine flow path.

A number of third baffles 84 are positioned within the second fluid flow passageway near the physical bottom of the apparatus 20 as shown in FIG. 2. In a preferred embodiment, the apparatus comprises a pair of third baffles positioned within the second fluid flow passageway at opposing sides of the drain coupling 54. Each third baffle extends radially away from the surface of baffle 50, a partial distance towards the inner surface of the outer wall 24. Each third baffle is attached at an arcuate end to the surface of the baffle 50 and is attached at one axial end to the end surface 40 of either the inlet or outlet side of the apparatus in a manner promoting serpentine flow through the second fluid flow passageway. The passageway that is formed between the unattached arcuate end of each third baffle and the inside surface of the outer wall 24 accommodates the gravitational passage of oil separated from the mixture within the second fluid flow passageway 70 downward into the drain coupling 54.

Figure 4:
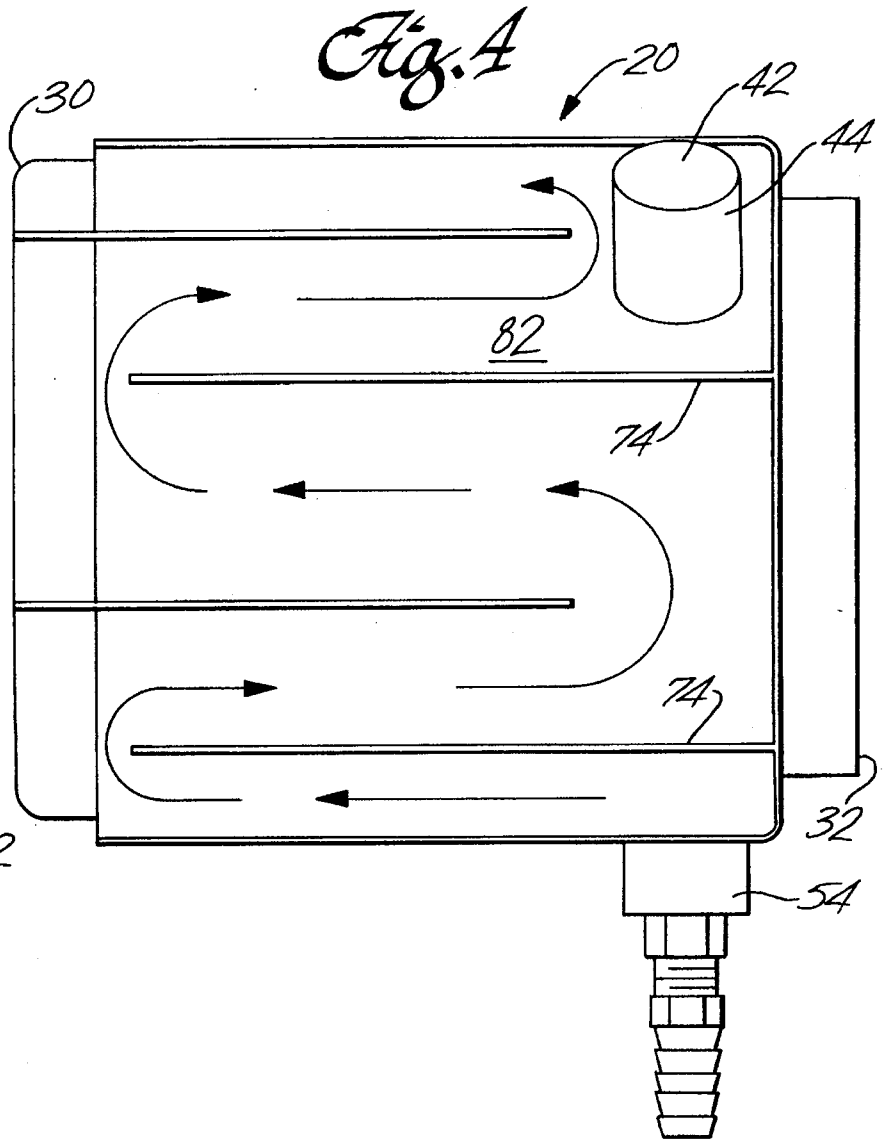
FIG. 4 is a semi-schematic cross-sectional side view of the apparatus of FIG. 1, looking at a second flow passageway.

As best shown in FIG. 4, the flow mixture entering the second fluid flow passageway 82 from the first fluid flow passageway is directed through the apparatus 20 a second time in a serpentine manner as represented by the arrows in a direction opposite to the mixture traveling through the first fluid flow passageway. The mixture traveling through the second fluid flow passageway is directed back towards the physical top of the apparatus, where it is directed around the outside surface of the tube 44 and through the secondary outlet 46.

Referring to FIG. 2, both the first and second fluid flow passageways 70 and 82 comprise filter material 86 positioned between the second baffles 74 and third baffles 86. The filter material facilitates the separation of entrained oil from the flow mixture entering the apparatus due to the enhanced collection sites provided by the material. The filter material may be selected from the groups of materials that are chemically resistant to the effects of heavy hydrocarbons. A particularly preferred filter material is polyester fiber.

The construction of the combination apparatus comprising a first and second fluid flow passageway and an arrangement of second and third baffles has been found to enhance the efficiency of air-oil separation when compared to that previously obtained by the combination apparatus disclosed and claimed in U.S. Pat. No. 5,140,957 and, therefore, is meant to be an improvement on the same. Specifically, the serpentine flow path provided by the apparatus operates to decrease the velocity of the flow mixture within the apparatus, increasing the residence time of the mixture within the apparatus and, thereby promoting condensation of oil vapor entrained in the flow mixture by enhanced contact with relatively cooler surfaces of the apparatus.

In the preferred embodiment of the combination apparatus 20, the secondary inlet 42 has a diameter of approximately 32 millimeters (1¼ inches). The secondary outlet 46 is in the shape of a rectangle with slightly rounded corners, and has an arcuate opening distance of approximately 89 millimeters (3.5 inches) and an axial opening distance of approximately 89 millimeters (3.5 inches). The inside diameter of the channel is preferably 152 millimeters (6 inches). The diameter of the first baffle (No. 50) is 178 millimeters (7 inches) and the diameter of the outer wall 24 is approximately 216 millimeters (8½ inches). The length of the axial end of each second baffle in the first and second fluid flow passageways is approximately 25 millimeters (1 inch). The length of the arcuate end of each second and third baffle is approximately 7 millimeters (0.3 inches). The length of the axial end of each third baffle is approximately 127 millimeters (5 inches).

In a preferred embodiment shown in FIG. 2, the second baffles in the first fluid flow passageway 70 are radially spaced apart at intervals of approximately 45°. The second baffles in the second fluid flow passageway 70 are radially spaced apart at intervals of approximately 45°. The third baffles in the second passageway are radially spaced apart at intervals of approximately 45°. The first fluid flow pathway comprises approximately eight second baffles 74 and the second fluid flow passageway comprises approximately four second baffles and two third baffles 84.

Although a specific combination apparatus has been described and illustrated, it is to be understood within the scope of this invention that the first, second and third baffles may be arranged differently than that described to achieve an enhanced residence time within the apparatus. For example, the second baffles may be positioned having different radial spacings or to promote other than serpentine flow through each respective flow passageway.

If desired, the second and third baffles 74 and 84 can be made from a polymeric material such as plastic and the like and molded into the combination apparatus 20 during an injection molding process. Alternatively, the second and third baffles may be made from a metallic material such as copper and the like, and can be inserted into slots provided in the apparatus during the molding or construction process.

Figure 5:
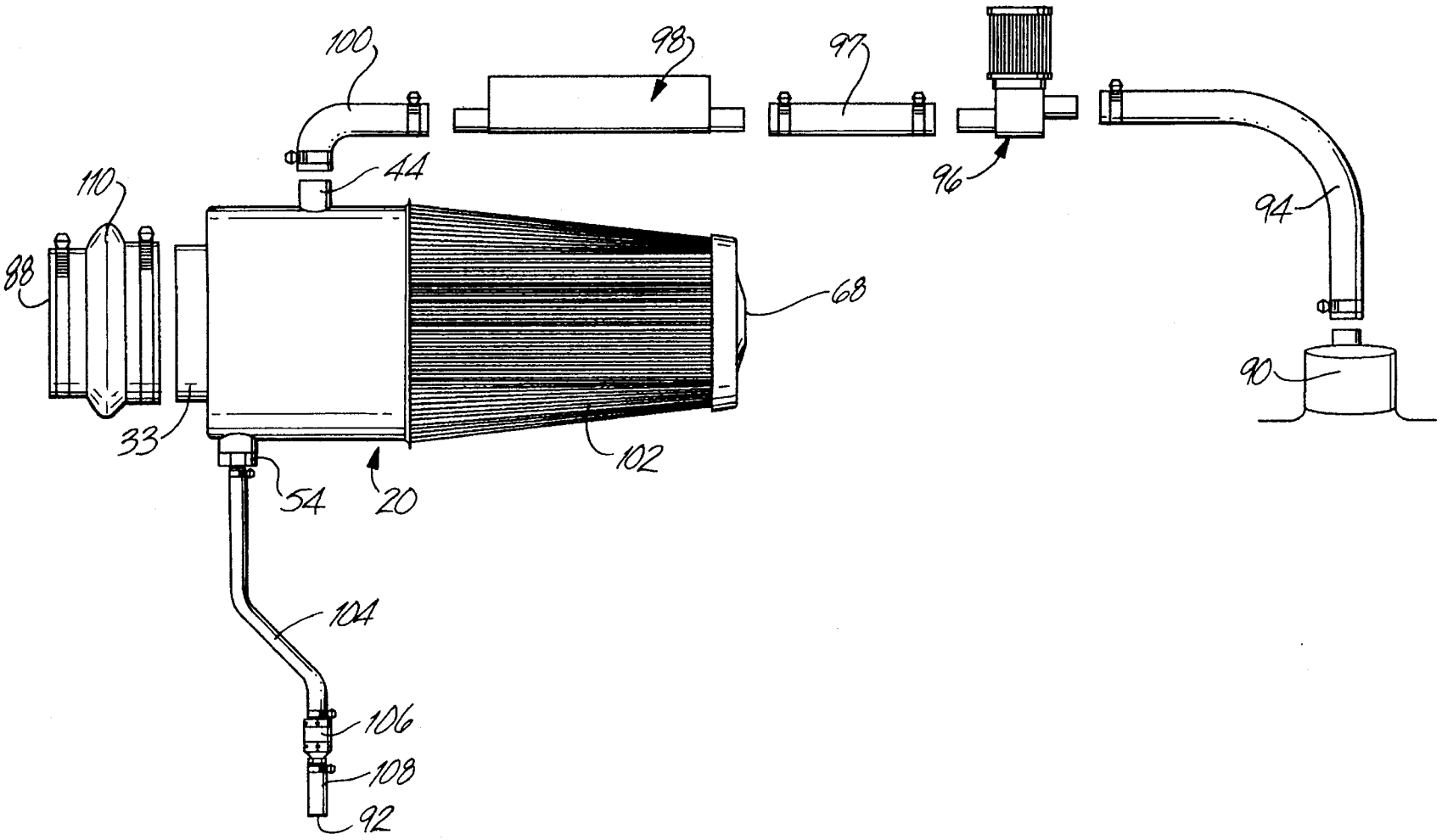
FIG. 5 is a schematic side view of hose connections for an air-oil separating system constructed according to principles of this invention comprising the combination apparatus, a preseparator apparatus, a vacuum regulator, and a fluid check valve.

FIG. 5 shows an air-oil separation system constructed according to principles of the present invention connected to an internal combustion engine having an air induction system 88, an engine breather 90, and an oil reservoir 92. The engine breather 90 is coupled through a breather hose 94 to a vacuum regulator 96. The vacuum regulator is coupled through a vacuum hose 97 to a preseparator apparatus 98. The preseparator apparatus is coupled through a preseparator hose 100 to the combination apparatus 20. The annular air filter 102 which fits over the air silencer 60 and primary gas inlet 30 of the annular housing 22 are clearly visible. However, the air silencer 60 and air silencer cap 68 are not visible in FIG. 5 because they are contained within the channel formed by the annular air filter and annular housing and are thus hidden from view. A fluid line 104 extends from the drain coupling 54 on the bottom of the annular housing and is coupled to a check valve 106. An oil line 108 extends from an outlet end of the check valve and extends to the engine's oil reservoir 92.

The primary gas outlet flange 33 of the combination apparatus 20 is coupled to an air intake hose 110 running to the engine's intake air turbo charger. Alternatively, engines without turbo chargers have the primary gas outlet of the combination apparatus coupled to the air-induction system for the engine. Generally, the filtering apparatus can be adapted to the crankcase and clean air intake system of any internal combustion engine.

Figure 6:
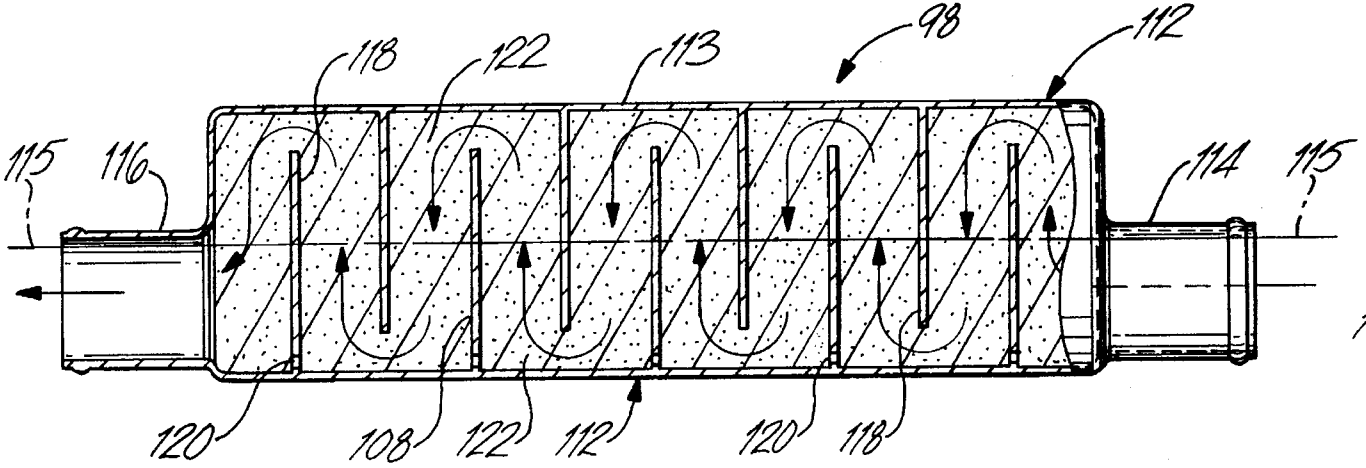
FIG. 6 is a semi-schematic cross-sectional side view of the preseparator apparatus of FIG. 5 viewed in an open position.

FIG. 6 shows a cross-sectional side view of the preseparator 98 apparatus of FIG. 5. The preseparator comprises an annular housing 112 having an inlet opening 114 at one end and an outlet opening 116 at an opposite end. The annular housing 112 has an outer wall 113 defining a central axis 115. The inside surface of the outer wall defines a fluid flow passageway between the inlet opening and the outlet opening. A plurality of preseparator baffles 118 are disposed within the housing perpendicular to the central axis 115 for the purpose of directing the flow of an air-oil mixture entering the housing in a serpentine flow path and, thus reducing the velocity of the mixture through the preseparator and the apparatus 20. In the preferred embodiment shown in FIGS. 6 and 7, the preseparator housing has a cylindrical shape with tubular inlet and outlet openings 114 and 116 at each end of the housing positioned near the physical bottom of the preseparator. The inlet and outlet openings are each positioned near the bottom of the preseparator to facilitate the flow of separated oil or other liquid contaminant therethrough.

The preseparator baffles 118 comprise circular plates attached about a partial circumferential edge to an inside surface of the outer wall 113. Each preseparator baffle 118 is arranged within the preseparator housing so that the unattached portion of each baffle is adjacent to attached portions of adjacent baffles, thereby inducing serpentine air flow through the preseparator by the passage of the air flow mixture between each unattached baffle portion and the inner surface of the preset housing, as shown by the arrows in FIG. 6. Preseparator baffles that are attached to the inside surface of the outer wall at the physical bottom of the preseparator have a baffle drainage hole 120 that extends through the thickness of the baffle. The baffle drainage holes are formed to accommodate the passage of separated oil or other liquid contaminant material through the preseparator baffles 118 attached to the bottom inside surface of the outer wall, and through the preseparator housing 112 where it can be transferred to the apparatus 20. Preferably, the baffle drainage holes are of a small dimension so that the passage of oil or other liquid material will act to seal the holes and, thus prevent the passage of the entering air-oil mixture therethrough. In a preferred embodiment, the drainage holes 120 have a diameter of approximately 3 millimeters (⅛ inch).

The preseparator comprises filter material 122 disposed within the housing between the baffles 118 to both reduce the flow velocity of the air mixture through the preseparator and to provide enhanced collection sites for the purpose of condensing oil vapor entering the preseparator and, thus promoting oil separation. The filter material may be the same as the filter material 86 previously described and illustrated for use in the combination apparatus 20. A preferred preseparator filter material is polyester.

The air-oil mixture passes through the filter material positioned between each baffle in a serpentine flow path, causing the air velocity of the mixture to be reduced and the residence time of the mixture within the preseparator housing to be increased. The increased residence time promotes condensation of the oil vapor entrapped within the air mixture by the interaction of the mixture through the filter material and the relatively cooler baffles and preset housing. The condensed oil drains by gravity to the bottom of the preseparator and migrates from the inlet end of the housing to the outlet opening 116 via passage through the drainage holes 120.

Like the baffles used in the combination apparatus 20, the preseparator baffles can be molded into the preseparator housing 112 during an injection molding process. Alternatively, the preseparator baffles may be inserted into slots provided in the preseparator housing during the construction process or injection molding. The preseparator baffles may also be made from a metallic material such as copper and the like.

Figure 7:
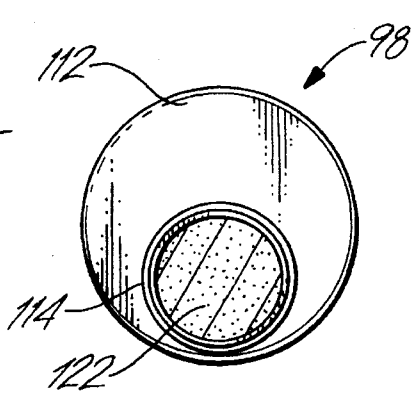
FIG. 7 is a front view of the preseparator apparatus of FIG. 6.

In a preferred embodiment as shown in FIGS. 6 and 7, the preseparator housing has an outside diameter of approximately 64 millimeters (2½ inches) and is approximately 208 millimeters (8.2 inches) long. The inlet and outlet opening 114 and 116 each have an outside diameter of approximately 32 millimeters (1¼ inch). The inlet and outlet openings each extend outwardly away from the preseparator housing a distance of approximately 36 millimeters (1.4 inches). The preseparator baffles have a diameter smaller than the inside diameter of the housing and are spaced apart at intervals of approximately 19 millimeters (¾ inches) within the housing. Accordingly, a preferred preseparator apparatus comprises approximately nine preseparator baffles.

Figure 8:
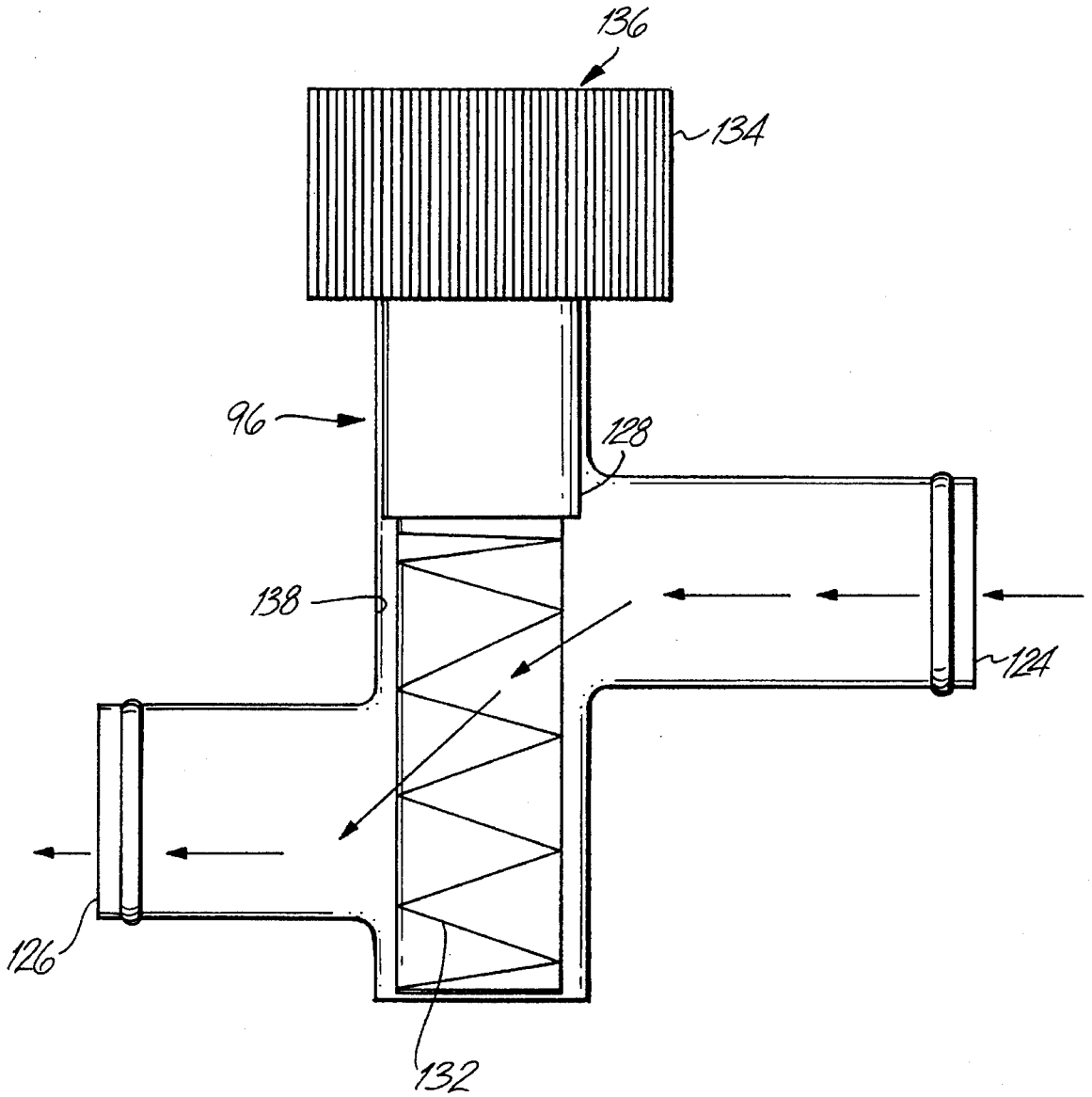
FIG. 8 is a semi-schematic cross-sectional side view of the vacuum regulator of FIG. 5 viewed in an open position.
Figure 9:
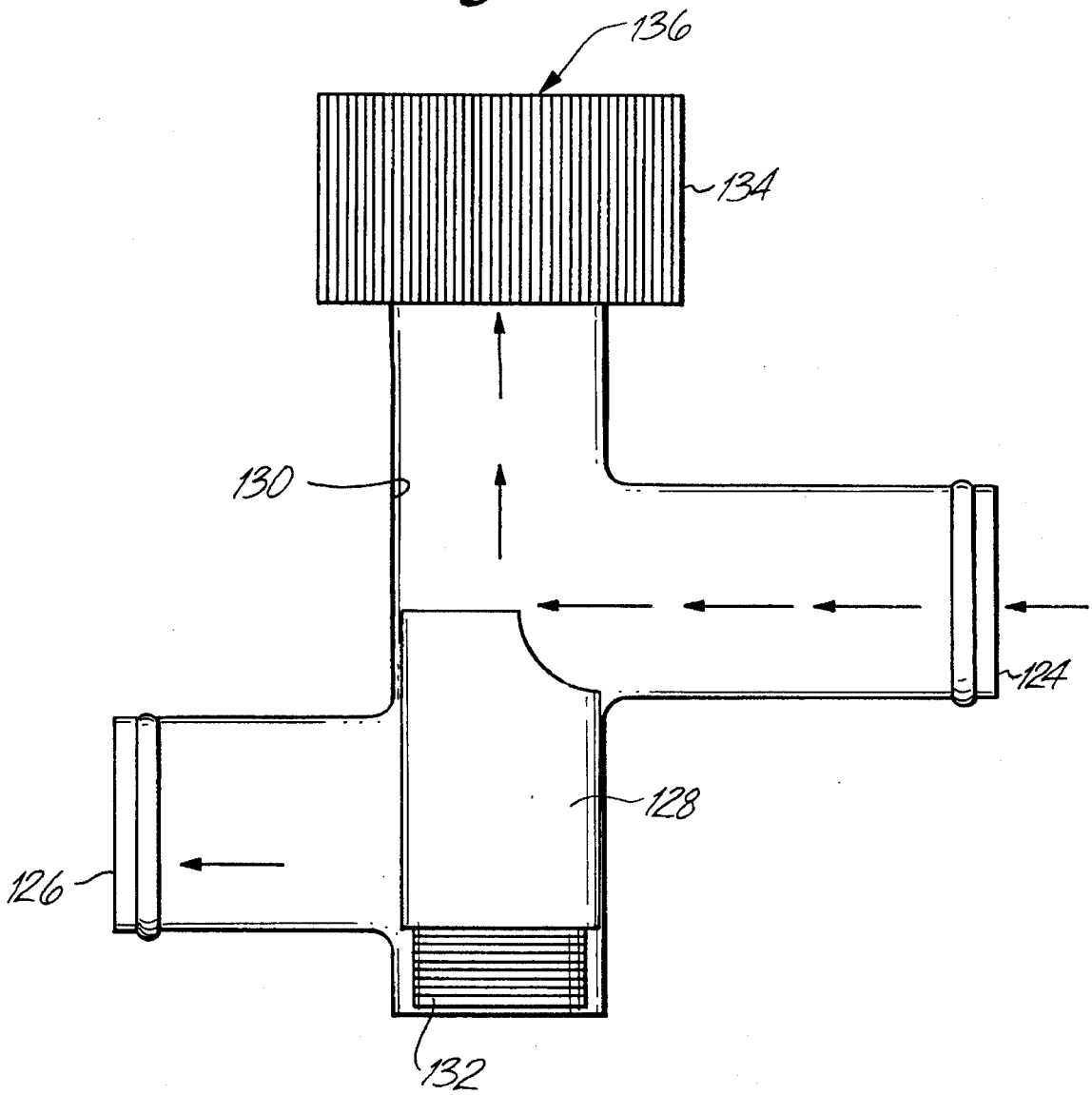
FIG. 9 is a semi-schematic cross-sectional side view of the vacuum regulator of FIG. 8 viewed in a closed position.

FIG. 8 shows a cross-sectional side view of the vacuum regulator 96 of FIG. 5. The vacuum regulator may comprise a vacuum limiter since both operate to reduce the amount of vacuum directed to the engine breather. A preferred vacuum limiter is one similar to that described and claimed in U.S. patent application Ser. No. 08/082,950 filed on Jun. 25, 1993. FIGS. 8 and 9 illustrate such a vacuum limiter as used in conjunction with the present invention. Accordingly, for purposes of describing and claiming this invention the terms vacuum regulator and vacuum limiter shall be used interchangably.

The vacuum regulator is coupled at an inlet port 124 to the breather hose 94 at an outlet port 126 to the vacuum hose 97 that extends to the preseparator apparatus 98. The vacuum regulator is a relief valve provided to control the amount of vacuum which is drawn on the engine by the separator apparatus 20 and, thereby prevent oil from being extracted from the engine crankcase via the engine breather 90. The vacuum regulator comprises a piston 128 disposed within a cylindrical chamber 130 and retained in an open position by a spring 132. The vacuum regulator comprises a air filter 134 that covers an air outlet 136 at the end of the chamber.

FIG. 8 shows the vacuum regulator 96 in an open position, thereby allowing the entering air mixture from the engine breather 90 to flow therethrough, as indicated by the arrows, from the inlet port 124 across the cylindrical chamber 130 and through the outlet port 126. As the vacuum created by the combination apparatus 20 and imposed on the vacuum regulator 96 increases with increased engine rpms, the piston 128 is drawn towards the outlet port and into the fully closed position within the chamber by the compression of spring 132, as best shown in FIG. 9. In the closed position, the piston completely blocks the passage of the air mixture from the inlet opening to the outlet opening and directs the air mixture into the chamber 130 and to the air outlet 136 as shown by the arrows where it passes through the air filter 134 into the atmosphere. Operating in this manner, the vacuum regulator prohibits the carry over of oil from the engine crankcase into preseparator and/or combination apparatus 20 by redirecting air flow under conditions of high vacuum.

Figure 10:
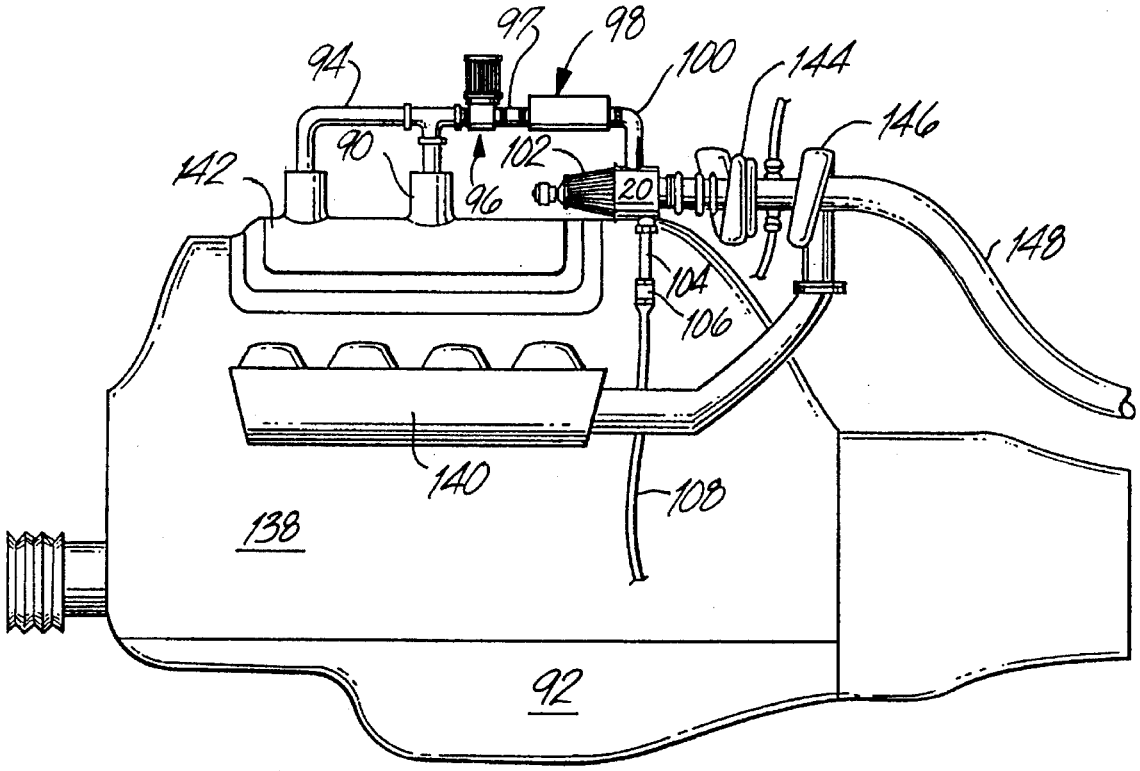
FIG. 10 is a schematic side view of an engine incorporating the combination apparatus, the preseparator apparatus, the vacuum regulator, and the fluid check valve of FIG. 5.

FIG. 10 shows the air-oil separating system constructed according to principles of this invention, comprising the combination apparatus 20, the preseparator apparatus 98, the vacuum regulator 96, and the check valve 106 mounted on an engine block 138 including an oil reservoir 92, an exhaust manifold 140, and a valve cover 142. The engine breather 90 is coupled through the breather hose 94 to the vacuum regulator 96. The vacuum regulator is coupled by the vacuum hose 97 to the preseparator apparatus 98. The preseparator is coupled through the preseparator hose 100 to the combination apparatus 20. Oil from the drain coupling 54 on the combination apparatus 20 passes through the fluid line 104 to the check valve 106 and to the oil reservoir 92 via the oil line 108.

The check valve operates to prevent the flow of oil from the oil reservoir into the induction system due to the vacuum that is created in the combination apparatus 20. In a typical engine operation there is a vacuum of approximately three inches of water generated in the oil reservoir. During typical operation, the combination apparatus 20 provides a vacuum of approximately six inches of water. Accordingly, during typical operation oil would flow from the oil reservoir (a place of relatively higher pressure) to the combination apparatus (a place of relatively lower pressure). The check valve is designed to prohibit this flow by being configured in the closed position, i.e. restricting fluid transfer from the oil reservoir to the combination apparatus, during typical operation. The check valve is configured to accommodate fluid transfer therethrough when the pressure in the fluid line 104 is greater than the pressure in the oil line 108, i.e., when the head pressure exerted upon the check valve by oil or other fluid in the fluid line is sufficient to overcome the three inch pressure differential between the oil reservoir and combination apparatus during typical operation. Oil is allowed to build up in the fluid line 104 until the pressure head created by the weight of oil in the pipe overcomes the vacuum differential, causing the check valve to open and allow the oil to flow into the oil reservoir. The check valve is returned to its closed position once the weight or amount of oil in the fluid line is less than that necessary to overcome the vacuum differential. The oil separated by the separating apparatus 20, therefore, is dispensed into the oil reservoir in a cyclical operation.

The outlet flange of the combination apparatus 20 is coupled to an air-intake turbo charger 144 through intake hose 110. The exhaust manifold 140 is coupled to an exhaust turbo charger 146, which in turn is coupled to the exhaust pipe 148. Alternatively, engines without turbo chargers have the primary outlet of the combination apparatus coupled to the air-induction system for the engine. Generally, the combination apparatus can be adapted to the crankcase and clean air intake of any internal combustion engine.

By referencing FIGS. 1–10 consider now the operation of the separator apparatus, preseparator, vacuum relief valve, and check valve. With the connections formed as shown in FIGS. 5 and 10, the air-intake turbo charger creates a vacuum for pulling air into the combination apparatus. The same effect is produced without a turbo charger when the primary gas outlet of the combination apparatus is coupled to the air-induction system of the engine. The air is pulled through the air filter 102, past the air silencer 60 and into the channel 26. The pulling effect of the turbo charger on the air in the channel produces a pressure differential between the secondary outlet 46 and the secondary gas inlet 42 of the combination apparatus, forcing contaminated air to flow out from the engine breather 90 through the breather hose 94, past the vacuum regulator 96, through the vacuum 97, through the preseparator 98, through the preseparator hose 100, and into the secondary inlet 42 of the combination apparatus.

The contaminated air evacuated from the engine breather is introduced into the preseparator apparatus 98 where the air is directed in a serpentine flow pattern through the preseparator, causing the velocity of the air to slow and a portion of the entrained oil vapor to condense. The air mixture and separated oil is routed to the combination apparatus where it is directed in a serpentine flow pattern through the first and second fluid flow passageways, causing the velocity of the air to be further slowed and the entrained oil vapor to condense to the liquid phase and be separated from the air. The oil is drained via gravity from the drain coupling 54 of the combination apparatus to the fluid line 104, where it is feed into the engine's oil reservoir by the check valve 106. The cleaned air passes through the secondary outlet 46 and merges with the filtered intake air in the channel 26 where it is directed through the air-intake turbo charger 144, which then transports the air to the engine as usual.

The pressure differential between the secondary inlet 42 and the secondary outlet 46 is assisted by the difference in cross-sectional area of the breather port 90 and the secondary outlet 46. The ratio of the cross-sectional area of the breather port to the cross-sectional area of the secondary outlet may be about 12%, but may have a range of values depending on the type of engine, etc. The ratio of the cross-sectional area may be in the range of from 8% to 25%, but no outside limit for the range has been defined.

Alternatively, all the pressure drop between the engine breather and the secondary outlet may occur within the annular housing of the combination apparatus 20 by making the diameter of the secondary inlet 42 the same as the diameter of the engine breather. In this embodiment, the range of cross-sectional areas can be maintained or adjusted by considering the diameter of the secondary outlet rather than that of the breather port.

The system of the present invention comprising the combination apparatus, preseparator apparatus, vacuum regulator, and check valve may be designed for any type of internal combustion engine, as long as the ratio of breather port to secondary outlet area is maintained in the desired range for a given efficiency or throughput. The efficiency of the separator apparatus may be changed by varying the diameter of the combination apparatus, i.e., increasing the surface area of the baffles and the interior surfaces in the housing and increasing the cross-sectional area of the flow path, or increasing the axial length of the annular housing, with the same result. The throughput may be changed by changing the breather port 90 or the secondary inlet 42 and outlet 46 cross-sectional areas.

Attachment of the separator apparatus 20 to an engine creates a slight vacuum in the engine's crankcase. The presence of oil droplets or particles in the crankcase atmosphere is due partly to the relatively high pressure in the crankcase. By attaching the combination apparatus to an engine, the pressure in the crankcase is eliminated and an actual slight vacuum replaces the high pressure crankcase atmosphere. The presence of a slight vacuum within the crankcase, e.g., three inches of water, serves to significantly decrease the amount of oil, contaminants and blowby products entrained in the crankcase air, and has been shown to reduce oil consumption by up to as much as 96%. It is significant that the vacuum created in the crankcase not be too large. Otherwise, a relatively large amount of oil and oil ladened air will be pulled from the crankcase. For example, if the air filter 102 becomes clogged for any reason, the suction created by the air-intake turbo charger or the air-induction system would increase the pressure differential between the breather and the combination apparatus. Accordingly, the vacuum regulator 96 described above is designed to prevent the occurrence of too large of a pressure differential.

The cross-sectional area of the first and second fluid flow passageways in the interior of the separating apparatus 20 are preferably greater than or approximately equal to the cross-sectional area of the secondary outlet 46. This maintains a low flow velocity through the passageways, maximizing the residence time of contaminated air within the passageways and thus promoting maximum oil condensation.

The in-line arrangement of the separating apparatus and preseparator apparatus provides for a pressure differential between the breather and the channel 26 for transferring the contaminated air from the breather. The design requires little modification of the air intake design of current engines and is simple and economical to assemble. Significantly, the in-line design with the filtered air being supplied to the induction system and the oil being returned to the oil reservoir produces a closed crankcase ventilation system that is environmentally desirable. This system conserves oil, returns light or unburned hydrocarbons to the induction system, creates a slight crankcase vacuum, increases fuel efficiency and prolongs engine lifetime.

It should be noted that the embodiments described and/or illustrated above are only considered to be preferred and illustrative of the inventive concepts and that others are foreseeable. Accordingly, it is to be understood that the scope of this invention is not to be restricted to such embodiments.

What is claimed is:

1. A combination apparatus for silencing and filtering air flow and separating air-contaminate mixtures, the apparatus comprising:

a housing having an outer wall and a channel having a channel wall disposed axially therein between a primary inlet and primary outlet;

an air filter joined to the primary inlet;

a secondary inlet port through the outer wall;

a secondary outlet port through the channel wall;

a first baffle extending axially in the housing between the outer wall and the channel wall; a first air flow passageway formed between the channel wall and an adjacent surface of the first baffle;

a second air flow passageway formed between the housing wall and an adjacent surface of the first baffle, wherein the first and second air flow passageways are constructed in series so that an air contaminate mixture entering through the secondary inlet port is routed through the housing from the first air flow passageway to the second air flow passageway and through the secondary outlet port; and a plurality of second baffles extending radially between the first baffle and the channel wall and the first baffle and the housing.

2. The combination apparatus as recited in claim 1 wherein there is no straight line flow path between the secondary inlet and secondary outlet.

3. The combination apparatus as recited in claim 1 wherein the air flow through the first flow passageway is directed through the housing in a direction opposite to the air flow through the second flow passageway.

4. The combination apparatus as recited in claim 1 wherein the secondary baffles are positioned to provide serpentine flow through the first and second flow passageway.

5. The combination apparatus as recited in claim 1 comprising filter material disposed between the housing and first baffle and between the first baffle and channel wall.

6. The combination apparatus as recited in claim 1 comprising a preseparator apparatus coupled to the secondary inlet for effecting a predetermined degree of oil separation from an entering air-oil mixture.

7. A combination apparatus for silencing and filtering air flow and separating air-contaminate mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet adapted to be coupled to an engine induction system, and having a channel wall, the channel wall having inside and outside surfaces;

a secondary inlet port through the outer wall;

a secondary outlet port defining an opening in the channel wall such that there is no straight line flow path between the secondary inlet and the secondary outlet;

a first baffle extending axially in the housing between the outer wall and the channel wall;

an air silencer contained within the channel;

a first air flow passageway between the secondary inlet port and the secondary outlet port defined exteriorly by the first baffle and interiorly by the channel wall;

a second air flow passageway between the secondary inlet port and the secondary outlet port defined exteriorly by the outer wall and interiorly by the first baffle, wherein the first and second air flow passageways are constructed in series so that an air contaminate mixture entering through the secondary inlet port is routed through the housing from the first air flow passageway to the second air flow passageway and through the secondary outlet port; and a plurality of second baffles disposed within the first and second flow passageways and extending radially between the first baffle and the channel wall and the first baffle and the outer wall, respectively;

8. The combination apparatus as recited in claim 7 wherein the air silencer comprises an annular sheet of perforated material contained within the channel, spaced away from the inside surface of the channel wall and oriented on the central axis, having sound deadening material filling the space between the annular sheet or perforated material and the inside surface of the channel wall, and having a section of the perforated material and sound deadening material cut away so as not to cover the secondary outlet in the channel wall.

9. The combination apparatus as recited in claim 7 further comprising a first baffle end connected between one end of the first baffle and the channel wall for directing the air-contaminant mixture circumferentially through the first flow passageway in one direction, and a channel wall end connected between the channel wall and the outer wall for directing the air-contaminate mixture exiting the first flow passageway circumferentially through the second flow passageway in an opposite direction.

10. The combination apparatus as recited in claim 9 wherein the second baffles each have a pair of opposing arcuate ends communicating with a respective channel wall and first baffle, and outer wall and first baffle, and have a length along an arcuate edge less than the distance between the primary gas inlet and primary gas outlet.

11. The combination apparatus as recited in claim 10 wherein the secondary baffles within the first and second flow passages are attached at one axial end to an end surface of the channel opposite to the end surface that each adjacent second baffle is attached, such that each second baffle attached to the primary gas inlet end of the channel is adjacent to at least one second baffle attached to the primary gas outlet end of the channel for effecting serpentine flow through the first and second flow passageways.

12. The combination apparatus as recited in claim 11 wherein the first and second flow passageways each comprise filter material disposed between the secondary baffles.

13. The combination apparatus as recited in claim 7 further comprising a preseparator apparatus coupled to the secondary inlet port.

14. The combination apparatus as recited in claim 13 wherein the preseparator apparatus comprises:

an annular housing having an outer wall defining a central axis;

a plurality of baffles disposed within the housing, each baffle being positioned perpendicular to the axis;

an inlet opening at one end of the housing positioned near a bottom portion of the housing; and an outlet opening at an opposite end of the housing positioned near a bottom portion of the housing.

15. The combination apparatus as recited in claim 13 wherein the first baffles of the preseparator apparatus are attached to the housing in a sequential arrangement providing serpentine flow of air through the preseparator from the inlet to the outlet opening.

16. The combination apparatus as recited in claim 15 wherein the preseparator apparatus further comprises filter material disposed between the preseparator baffles.

17. The combination apparatus as recited in claim 13 further comprising a vacuum regulator coupled by flow lines between the preseparator apparatus and an engine crankcase breather for limiting a vacuum in the flow lines.

18. The combination apparatus as recited in claim 17 wherein the vacuum regulator comprises a vacuum relief valve drawn into a closed position, closing an air flow passageway between the engine crankcase and an engine air-induction system by an increase in vacuum beyond a predetermined level.

19. The combination apparatus as recited in claim 7 further comprising a drain coupled to the outer wall of the housing for eliminating liquid contaminant from the housing.

20. The combination apparatus as recited in claim 19 wherein the drain and the primary gas outlet comprise the only outlet for flow from the secondary inlet.

21. The combination apparatus as recited in claim 19 further comprising a fluid line connected to the drain, the fluid line comprising a check valve whereby liquid contaminant only flows one-way through the line in a direction away from the housing; and wherein the combination apparatus, the induction system and the return line comprise a closed crankcase ventilation system.

22. The combination apparatus as recited in claim 7 wherein the secondary inlet and secondary outlet each comprise respective cross-sectional areas and wherein the cross-sectional area of the secondary inlet is less than the cross-sectional area of the secondary outlet.

23. A combination apparatus for silencing and filtering air flow and separating air-contaminant mixtures, the apparatus comprising:

an annular housing with an outer wall and a secondary inlet port extending through the outer wall;

a channel in the housing defining a central axis and having a primary gas inlet on one end coupled to an air filter, and a primary gas outlet on an opposite end adapted to be coupled to an engine induction system;

a channel wall in the housing with inside and outside surfaces and a secondary outlet port defining an opening in the channel wall such that there is no straight line flow path between the secondary inlet and the secondary outlet;

a drain formed in the outer wall of the housing to facilitate removal of liquid contaminant from the apparatus;

a first baffle extending axially in the housing between the outer wall and the channel wall;

a first flow passageway defined exteriorly by the first baffle and interiorly by the channel wall, the first baffle having an opening to accommodate the passage of the air-contaminate mixture from the secondary inlet port and into the first flow passageway;

a second flow passageway defined exteriorly by the outer wall and interiorly by the first baffle, the second flow passageway being serially connected to the first flow passageway such that the air-contaminate mixture exiting the first flow passageway enters the second flow passageway for passage of air-contaminant mixture toward the secondary outlet, wherein the secondary outlet port is positioned in the channel wall on a side of the housing substantially the same as the secondary inlet; and a plurality of second baffles disposed within the first and second flow passageways, the second baffles being disposed radially between the channel wall and first baffle in the first flow passageway and between the first baffle and outer wall in the second flow passageway, the second baffles being disposed axially between the primary gas inlet and outlet ends of the housing to direct the flow of the air-contaminate mixture through each first and second flow passageway in a serpentine flow pattern.

24. The combination apparatus as recited in claim 23 further comprising a number of third baffles disposed within the second flow passageway extending radially from the first baffle a partial distance to the outer wall and being located near the physical bottom of the housing to facilitate drainage of separated liquid contaminant along the outer wall.

25. The combination apparatus as recited in claim 24 further comprising filter materials disposed between the second baffles and between the third baffles for reducing air flow velocity and enhancing oil vapor condensation sites.

26. The combination apparatus as recited in claim 25 further comprising a plurality of drainage holes extending though the first baffle located near the physical bottom of the apparatus to facilitate drainage of liquid contaminant from the first flow passageway to the second flow passageway and to the drain for removal.

27. The combination apparatus as recited in claim 23 wherein the channel wall is attached to the first baffle by a first baffle end that extends in a radial manner from the channel wall to the first baffle, the first baffle end being positioned adjacent to the first baffle opening and forming an arcuate edge of the secondary outlet.

28. The combination apparatus as recited in claim 27 wherein the channel wall is attached to the outer wall by a channel end that extends radially from the channel wall to the outer wall, the channel end being positioned a distance from the first baffle end and forming an opposite arcuate edge of the secondary outlet.

29. The combination apparatus as recited in claim 28 wherein the first baffle is spaced away from the channel end to provide a serial air-contaminate mixture flow path from the first flow passageway to the second flow passageway.

30. The combination apparatus as recited in claim 23 further comprising a preseparator apparatus coupled at an outlet opening to the secondary inlet, the preseparator apparatus comprising:

an annular housing having an outer wall defining a central axis, the housing having an inlet opening at an end of the housing opposite to the outlet opening; and a plurality of preseparator baffles disposed within the housing at predetermined intervals perpendicular to the axis.

31. The combination apparatus as recited in claim 30 wherein the inlet and outlet openings of the preseparator apparatus are oriented near the physical bottom of the annular housing to facilitate the passage of liquid contaminant therethrough.

32. The combination apparatus as recited in claim 31 wherein the preseparator baffles are each smaller in dimension than the housing and are attached to the outer wall in a staggered arrangement to direct the air-contaminate through the preseparator apparatus in a serpentine flow pattern.

33. The combination apparatus as recited in claim 32 wherein the preseparator baffles that are attached to the outer wall at the physical bottom and each comprise at least one drain hole located near the outer wall to facilitate the passage of liquid contaminant therethrough.

34. The combination apparatus as recited in claim 33 wherein the preseparator further comprises filter material disposed between the preseparator baffles.

35. The combination apparatus as recited in claim 30 further comprising a vacuum regulator coupled at an outlet port to the preseparator apparatus and at an inlet port to an engine crankcase breather, the vacuum regulator comprising a vacuum relief valve drawn into a closed position, closing an air flow passageway between the engine crankcase and engine air-induction system by an increase in vacuum beyond a predetermined level.

36. The combination apparatus as recited in claim 35 further comprising a check valve coupled by a fluid line to the drain of the combination apparatus, the check valve permitting one-way passage of liquid contaminant in the fluid line in a direction away from the combination apparatus housing, liquid contaminant passage occurring when the head pressure of the liquid within the fluid line is sufficient to overcome a predetermined threshold pressure level, the liquid contaminant being routed via an oil line to an engine block.

37. An improved internal combustion engine having an induction system and an engine block with an engine breather, the improvement comprising:

a combination apparatus for silencing and filtering air flow and separating air-contaminant mixtures, the apparatus comprising:

an air filter joined to an annular housing having an outer wall;

a channel in the housing defining a central axis, having on one end of the channel a primary gas inlet coupled to the air filter, and having on the opposite end of the channel a primary gas outlet, and having a channel wall with inside and outside surfaces;

a secondary inlet port through the outer wall;

a secondary outlet port defining an opening in the channel wall such that there is no straight line flow path between the secondary inlet and the secondary outlet;

an air silencer contained within the channel;

a first baffle disposed axially within the housing between the outer wall and the channel wall, the first baffle defining a first and second flow passageway between the first baffle and channel wall and between the first baffle and outer wall, respectively, to provide serial air-contaminant mixture flow therethrough so that an air contaminate mixture entering through the secondary inlet port is routed through the housing from the first flow passageway to the second flow passageway and through the secondary outlet port;

a plurality of second baffles disposed within the first and second flow passageways and extending radially within each passageway to direct the air-contaminant mixture flow within each first and second flow passageway in a serpentine flow pattern; and a drain coupled to the outer wall to facilitate removal of liquid contaminant from the combination apparatus.

38. The improved internal combustion engine as recited in claim 37 further comprising filter material disposed within the first and second flow passageways between the second baffles.

39. The improved internal combustion engine as recited in claim 38 wherein the first baffle comprises an opening on a side of the housing adjacent to the secondary inlet for passage of the air-contaminant mixture from the second flow passageway to the secondary outlet.

40. The improved internal combustion engine as recited in claim 39 further comprising a number of third baffles disposed within the second flow passageway and extending radially away from the first baffle a partial distance toward the outer wall at a location near the physical bottom of the housing, the third baffles serving to facilitate the passage of liquid contaminant along the outer wall.

41. The improved internal combustion engine as recited in claim 37 further comprising a preseparator apparatus coupled between the engine breather and the secondary inlet for reducing the flow velocity of the air-contaminant mixture entering the combination apparatus.

42. The improved internal combustion engine as recited in claim 41 wherein the preseparator apparatus comprises:

an annular housing having an outer wall defining a central axis;

an inlet opening at one end of the housing and being coupled to the engine breather;

an outlet opening at an opposite end of the housing and being coupled to the secondary inlet; and a plurality of preseparator baffles disposed within the housing.

43. The improved internal combustion engine as recited in claim 42 wherein the preseparator baffles are each positioned perpendicular to the central axis and are attached to the outer wall at predetermined intervals in a staggered arrangement to direct the air-contaminant mixture in a serpentine flow pattern through the preseparator.

44. The improved internal combustion engine as recited in claim 43 wherein the preseparator apparatus further comprises filter material disposed within the housing between the preseparator baffles.

45. The improved internal combustion engine as recited in claim 44 wherein each preseparator baffle is attached to the outer wall near the physical bottom of the housing and comprises at least one drainage hole located near the physical bottom to facilitate the passage of liquid contaminant therethrough.

46. The improved internal combustion engine as recited in claim 45 wherein the inlet and outlet openings of the preseparator apparatus are located near the physical bottom of the housing to facilitate the passage of liquid contaminant through the preseparator.

47. The improved internal combustion engine as recited in claim 37 further comprising a vacuum regulator coupled between the engine breather and the secondary inlet for limiting a vacuum imposed on the engine breather by the combination apparatus.

48. The improved internal combustion engine as recited in claim 47 wherein the vacuum regulator comprises:

a housing having a flow passageway therethrough and an inlet and outlet port at opposite ends of the passageway;

a chamber extending transversely of the passageway and in communication with the passageway, the chamber having an open end and a closed end;

a piston located within the chamber, the piston being movable within the chamber for adjusting the effective size of the passageway; and a spring for biasing the piston in an open position adjacent the open end whereby an increase in vacuum of predetermined magnitude in the passageway pulls the piston toward the closed end of the chamber, thereby limiting the size of or completely closing the passageway and opening a pathway to atmosphere through the open end.

49. The improved internal combustion engine as recited in claim 47 further comprising a check valve coupled by fluid flow lines between the drain and the engine block to permit one-way flow of liquid contaminant in a direction away from the combination apparatus and to the engine block.

50. The improved internal combustion engine as recited in claim 49 wherein the check valve is designed to permit one-way flow when the liquid contaminant in the fluid flow line that couples the check valve to the drain has a pressure head of sufficient magnitude to overcome a predetermined threshold pressure level.

51. An improved internal combustion engine having an induction system, and an engine block with an engine breather, the improvement comprising:

a combination apparatus for silencing and filtering air flow and separating air-contaminant mixtures, the apparatus comprising:

an air filter joined to an annular housing having an outer wall;

a channel in the housing defining a central axis, the housing having on one end of the channel a primary gas inlet coupled to the air filter and having on the opposite end of the channel a primary gas outlet, and having a channel wall with inside and outside surfaces;

a secondary inlet port through the outer wall;

a secondary outlet port defining an opening in the channel wall such that there is no straight line flow path between the secondary inlet and the secondary outlet;

an air silencer contained within the channel;

a first baffle disposed axially within the housing between the outer wall and the channel wall;

a first flow passageway defined exteriorly by the first baffle and interiorly by the channel wall, the first baffle having an opening to accommodate the passage of the air-contaminate mixture from the secondary inlet port and into the first flow passageway;

a second flow passageway defined exteriorly by the outer wall and interiorly by the first baffle, the second flow passageway being serially connected to the first flow passageway such that the air-contaminate mixture exiting the first flow passageway enters the second flow passageway for passage of the air-contaminant mixture toward the secondary outlet, wherein the secondary outlet port is positioned in the channel wall on a side of the housing substantially the same as the secondary inlet;

a plurality of second baffles disposed radially within the first and second flow passageways to direct the air-contaminant mixture flow within each first and second flow passageway in a serpentine flow pattern; and;

a drain coupled to the outer wall to permit the removal of liquid contaminant from the housing; a preseparator apparatus coupled between the engine breather and the secondary inlet, the preseparator apparatus comprising:

an annular housing having an outer wall defining a central axis;

an inlet opening at one end of the housing coupled to the engine breather;

an outlet opening at an opposite end of the housing coupled to the secondary inlet; and a plurality of preseparator baffles disposed within the housing.

52. The improved internal combustion engine as recited in claim 51 wherein the combination apparatus further comprises filter material disposed within the first and second flow passageways between the second baffles.

53. The improved internal combustion engine as recited in claim 52 wherein the first baffle comprises an opening on a side of the housing adjacent to the secondary inlet for passage of the air-contaminant mixture from second flow passageway to the secondary outlet.

54. The improved internal combustion engine as recited in claim 53 further comprising a number of third baffles disposed within the second flow passageway and extending radially away from the first baffle a partial distance toward the outer wall at a location near the physical bottom of the housing, the third baffles serving to facilitate the passage of liquid contaminant along the outer wall.

55. The improved internal combustion engine as recited in claim 54 wherein the preseparator baffles are each positioned within the housing perpendicular to the central axis and are attached to the outer wall at predetermined intervals in a staggered arrangement to direct the air-contaminant mixture in a serpentine flow pattern through the preseparator.

56. The improved internal combustion engine as recited in claim 55 wherein the preseparator apparatus further comprises filter material disposed within the housing between the preseparator baffles.

57. The improved internal combustion engine as recited in claim 56 wherein the inlet and outlet openings of the preseparator apparatus are located near the physical bottom of the housing to facilitate the passage of liquid contaminant through the preseparator.

58. The improved internal combustion engine as recited in claim 57 further comprising a vacuum regulator coupled between the engine breather and the inlet opening of the preseparator apparatus for limiting a vacuum imposed on the engine breather by the combination apparatus, the vacuum regulator comprising a vacuum relief valve drawn into a closed position, closing an air flow passageway between the engine crankcase and an engine induction system by an increase in vacuum beyond a predetermined level.

59. The improved internal combustion engine as recited in claim 57 further comprising a check valve coupled by fluid flow lines between the drain and the engine block to permit one-way flow of liquid contaminant in a direction away from the combination apparatus and to the engine block.

60. The improved internal combustion engine as recited in claim 59 wherein the check valve is designed to permit one-way flow when the liquid contaminant in the fluid flow line that couples the check valve to the drain has a pressure head of sufficient magnitude to overcome a predetermined threshold pressure level.

* * * * *